US011007746B2

(12) United States Patent
Wetsch et al.

(10) Patent No.: US 11,007,746 B2
(45) Date of Patent: May 18, 2021

(54) DUNNAGE SUPPLY INTAKE

(71) Applicant: PREGIS INNOVATIVE PACKAGING LLC, Deerfield, IL (US)

(72) Inventors: Thomas D. Wetsch, St. Charles, IL (US); Eric Charles Wright, Bolingbrook, IL (US)

(73) Assignee: Pregis Innovative Packaging LLC, Deerfield, IL (US)

( * ) Notice: Subject to any disclaimer, the term of this patent is extended or adjusted under 35 U.S.C. 154(b) by 616 days.

(21) Appl. No.: 15/593,255

(22) Filed: May 11, 2017

(65) Prior Publication Data

US 2018/0326687 A1 Nov. 15, 2018

(51) Int. Cl.
*B31D 5/00* (2017.01)
*B65D 81/05* (2006.01)

(52) U.S. Cl.
CPC .... *B31D 5/0047* (2013.01); *B31D 2205/0023* (2013.01); *B31D 2205/0047* (2013.01); *B31D 2205/0058* (2013.01); *B65D 81/05* (2013.01)

(58) Field of Classification Search
CPC ..... B31D 5/0047; B31D 2205/0023; B31D 2205/0047; B31D 2205/0058; B65D 81/05
USPC ..... 493/464
See application file for complete search history.

(56) References Cited

U.S. PATENT DOCUMENTS 2,786,399 A 3/1957 Mason et al.
3,001,735 A 9/1961 Francik
3,052,146 A 9/1962 Glendening
3,509,797 A * 5/1970 Johnson ..... B31D 5/0047 493/340
3,509,798 A 5/1970 Johnson
3,542,268 A 11/1970 Schramm
3,650,877 A 3/1972 Johnson
3,741,403 A 6/1973 Fleischer
(Continued)

FOREIGN PATENT DOCUMENTS

DE 19520907 1/1996
EP 1026113 A2 8/2000
(Continued)

OTHER PUBLICATIONS

Supplemental International Search Report and Written Opinion dated Dec. 31, 2018 for International Application No. PCT/US2016/032376, filed May 11, 2018.
(Continued)

*Primary Examiner* — Sameh Tawfik
(74) *Attorney, Agent, or Firm* — Fox Rothschild LLP

(57) ABSTRACT

Disclosed herein is a dunnage conversion machine for converting stock material to dunnage. The dunnage conversion machine includes a converting station and a drive mechanism positioned downstream of the converting station. The converting station includes a dunnage intake and a shaping member. The intake member includes an opening that constricts stock material as the stock material is pulled into and through the intake. The shaping member is positioned upstream of the intake member. The shaping member manipulates the path of the stock material in a way that causes the stock material to begin to bend or curl prior to being pulled into the intake. The drive mechanism receives the stock material and pulls the stock material over the shaping member.

23 Claims, 6 Drawing Sheets

(56) References Cited

U.S. PATENT DOCUMENTS 4,450,996 A 5/1984 Kamp
4,598,531 A 7/1986 Ruff et al.
4,699,609 A 10/1987 Komaransky et al.
5,078,311 A 1/1992 Taguchi et al.
5,131,903 A 7/1992 Levine et al.
5,188,581 A 2/1993 Baldacci
5,211,620 A * 5/1993 Ratzel ..... B31D 5/0047 493/346
5,219,126 A 6/1993 Schutz
5,232,430 A 8/1993 Nitsch
5,322,477 A 6/1994 Armington et al.
5,377,570 A 1/1995 Giljam
5,387,173 A * 2/1995 Simmons, Jr. ..... B31D 5/0047 493/407
5,439,730 A 8/1995 Kelly et al.
5,474,250 A 12/1995 Birkmann et al.
5,829,231 A 11/1998 Harding et al.
5,864,484 A 1/1999 Harding
6,095,454 A 8/2000 Simmons
6,179,765 B1 * 1/2001 Toth ..... B26D 7/24 493/360
6,237,449 B1 5/2001 Orlosky
6,378,800 B1 4/2002 Apichom
6,524,230 B1 2/2003 Harding et al.
6,632,165 B1 10/2003 Letourneau et al.
6,632,311 B1 10/2003 Glenna et al.
6,673,001 B2 1/2004 Toth
6,695,247 B2 2/2004 Widlund
6,702,212 B2 3/2004 Abba et al.
6,756,096 B2 6/2004 Harding
6,790,302 B2 9/2004 Franz et al.
6,802,467 B2 10/2004 Abba et al.
6,887,329 B2 5/2005 Harding
6,910,997 B1 * 6/2005 Yampolsky ..... B26F 1/22 493/350
6,981,352 B2 1/2006 Chow et al.
7,066,422 B1 6/2006 Slocum
7,083,560 B2 8/2006 Kobben et al.
7,186,208 B2 * 3/2007 Demers ..... B26F 3/02 493/350
7,347,809 B2 3/2008 Toth
7,407,471 B2 8/2008 Demers et al.
7,479,100 B2 1/2009 Toth
7,481,163 B2 1/2009 Theilacker
7,484,341 B2 2/2009 Hidetoshi
7,585,268 B2 9/2009 Cheich et al.
7,651,455 B2 1/2010 Yampolsky et al.
7,744,519 B2 6/2010 Wetsch et al.
7,771,338 B2 8/2010 Wetsch et al.
8,016,735 B2 9/2011 Wetsch et al.
8,554,363 B2 10/2013 Sperry et al.
8,555,761 B2 10/2013 Keily et al.
8,641,591 B2 2/2014 Wetsch
8,820,238 B2 9/2014 Brandenburg et al.
8,900,111 B2 12/2014 Wetsch et al.
9,254,578 B2 2/2016 Wetsch et al.
9,321,235 B2 * 4/2016 Cheich ..... B31D 5/0047
10,093,070 B2 * 10/2018 Lintala ..... B31D 5/0047
2002/0193224 A1 12/2002 Toth
2003/0073558 A1 * 4/2003 Chesterson ..... B31D 5/0052 493/250
2003/0092552 A1 5/2003 Armington et al.
2004/0142806 A1 7/2004 Coppus et al.
2004/0266598 A1 12/2004 Toth
2005/0247220 A1 11/2005 Brandenburg et al.
2007/0117703 A1 * 5/2007 Cavaliere, Jr. ..... B31D 5/0052 493/464
2007/0117704 A1 5/2007 Toth
2008/0070773 A1 * 3/2008 Wetsch ..... B31D 5/0052 493/464
2008/0076653 A1 3/2008 Shaw et al.
2008/0098699 A1 * 5/2008 Cheich ..... B31D 5/0047 53/472
2008/0207421 A1 8/2008 Wetsch
2008/0261794 A1 10/2008 Slovencik
2009/0023570 A1 1/2009 Kung et al.
2009/0026306 A1 1/2009 Kempster et al.
2009/0231123 A1 9/2009 Rowell et al.
2010/0029456 A1 2/2010 Cheich
2010/0127112 A1 5/2010 Aquarius et al.
2010/0132529 A1 6/2010 Miyazaki
2011/0052875 A1 3/2011 Wetsch et al.
2011/0053750 A1 3/2011 Wetsch et al.
2012/0035038 A1 2/2012 Limbach et al.
2012/0165172 A1 6/2012 Wetsch et al.
2012/0329629 A1 12/2012 Wetsch et al.
2013/0092716 A1 4/2013 Wetsch et al.
2013/0105613 A1 5/2013 Persson
2015/0014205 A1 1/2015 Yap et al.
2015/0126351 A2 5/2015 Wetsch et al.
2017/0021585 A1 1/2017 Wetsch et al.

FOREIGN PATENT DOCUMENTS

FR 2667854 4/1992
FR 2808726 A1 11/2001
GB 2173141 A 10/1986
WO 2009126838 A2 10/2009
WO 2015061635 A1 4/2015

OTHER PUBLICATIONS

Partial International Search Report and Written Opinion dated Aug. 23, 2018 for International Application No. PCT/US2016/032376, filed May 11, 2018.

* cited by examiner

DUNNAGE SUPPLY INTAKE

TECHNICAL FIELD

This invention is in the field of protective packaging systems and materials, particularly for the conversion of stock material used in the protective packaging systems.

BACKGROUND

In the context of paper-based protective packaging, paper sheet is crumpled to produce dunnage. Most commonly, this type of dunnage is created by running a generally continuous strip of paper into a dunnage conversion machine that converts a compact supply of stock material, such as a roll of paper or a fanfold stack of paper, into a lower density dunnage material. The supply of stock material, such as in the case of fanfold paper, is pulled into the conversion machine from a stack that is either continuously formed or formed with discrete section connected together. The continuous strip of crumpled sheet material may be cut into desired lengths to effectively fill void space within a container holding a product. The dunnage material may be produced on an as-needed basis for a packer.

A variety of different types of stock material are used to form the dunnage material. On method of converting stock material into less dense dunnage is by constricting the path of the stock material via a funnel or similar constricting device. Some traditional devices can cause degradation of stock material, such as tearing, as the path compresses the stock material along the constricted portion of the path.

SUMMARY

Disclosed herein is a dunnage converting station that pulls stock sheet material in a longitudinal direction from a supply station and converts the stock material into low-density dunnage. The dunnage converting station may include an intake member. The dunnage converting station also includes a stock material shaping member positioned upstream of the intake member and on an upstream portion of the converting station to bend the stock material pulled from the supply station about a transverse axis that extends generally transversely to the longitudinal direction. The stock material shaping member may include a support structure that extends in generally the same direction as the transverse axis and causes the stock material to bend about the transverse axis. The stock material shaping member may include a central protrusion that protrudes more deeply into the bend in the stock material than the support structure. The central protrusion may cause the stock material to bend about both the transverse axis and a longitudinal axis that extends generally in the longitudinal direction generally centrally into the stock material as the stock material moves longitudinally across the support structure and the central protrusion.

In accordance with embodiments discussed herein, the central protrusion may extend radially from the support structure. The dunnage converting station may include a drive mechanism operable to pull the stock material into the intake member. The intake may include a structural member that defines an opening disposed between the shaping member and the drive mechanism. The opening may constrict the stock material as the stock material is pulled into and through the dunnage intake member in a longitudinal direction. The shaping member may manipulate the path of the stock material in a way that causes the stock material to begin to bend or curl prior to being pulled into the intake member. The support structure may extend across less than a full width of the stock material. Alternatively, the support structure may extend across more than a full width of the stock material. The support structure may be a transversely extending cylindrical bar. The bar may include transverse free ends that allow sufficiently wide stock material to wrap around the free ends. The central protrusion may be a semi-circular protrusion, with the semi-circular protrusion having an axis that is perpendicular to a transversely extending axis of the support structure. The central protrusion may extend away from the support member a distance between approximately 1/10 and 1/2 of the length of the support structure. The central protrusion may extend rearwardly between about 15° and 75° off a horizontal plane passing through a center axis of the support structure. The shaping member may be connected to the dunnage intake member by a connection member extending therefrom. The shaping member may be positioned to change the direction of the stock material as the stock material is pulled from a supply station and through the intake. The shaping member may be between 2 and 8 times wider than the opening.

A dunnage system may include the above described dunnage converting station and a supply station configured to hold stock material. The supply station may be configured to hold stock material that is wider than the width of the shaping member.

Disclosed herein is a dunnage conversion machine having a dunnage converting station. The dunnage converting station may include an outer structure that defines an opening that constricts stock material as a stock material is pulled into and through the dunnage intake member. The dunnage converting station may include a transverse barrier member extending from the outer structure in a direction that corresponds to the direction of the transverse width of stock material that is pulled into and through the dunnage intake such that the transverse barrier member limits the tendency of the stock material to wrap around the outer structure without significantly restraining the stock material in an upstream direction. The dunnage converting station may include a drive mechanism positioned downstream of the converting station. The drive mechanism may receive and pull the stock material through the dunnage intake member.

In accordance with embodiments described herein, the transverse barrier member may include ears protruding transversely from the dunnage intake and having a height less than the dunnage intake. At least one ear may form an attachment to the stand. The converting station may also include a shaping member positioned upstream of the intake. The shaping member may be configured to manipulate the stock material along its path in a way that causes the stock material to begin to bend or curl prior to being pulled into the intake.

BRIEF DESCRIPTION OF THE DRAWINGS

The drawing figures depict one or more implementations in accordance with the present concepts, by way of example only, not by way of limitations. In the figures, like reference numerals refer to the same or similar elements.

DETAILED DESCRIPTION

Figure 1C:
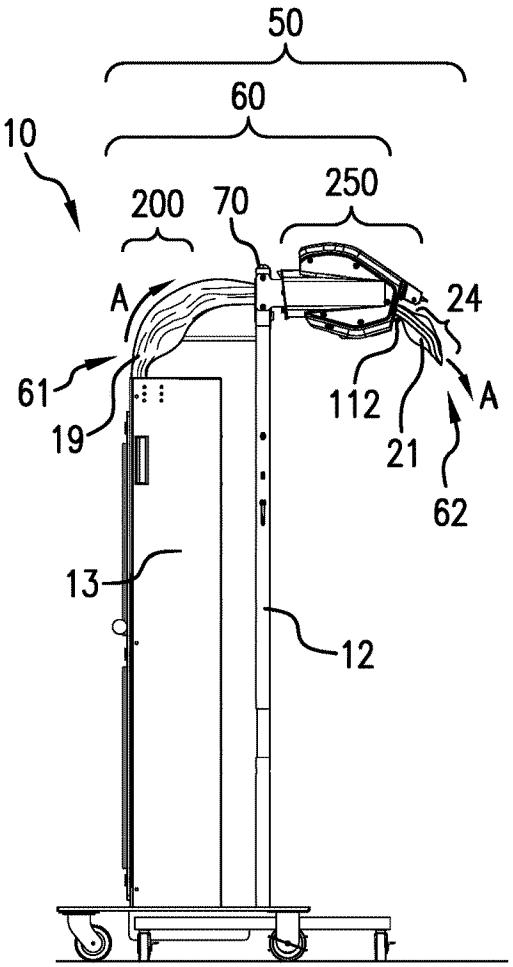
FIG. 1C is a side view of the embodiment of FIG. 1A of the dunnage conversion system.

A system and apparatus for converting a stock material into dunnage is disclosed. The present disclosure is generally applicable to systems and apparatus where supply material, such as a stock material, is processed. The stock material is processed by longitudinal crumple machines that form creases longitudinally in the stock material to form dunnage or by cross crumple machines that forms creases transversely across the stock material. The stock material may be stored in a roll (whether drawn from inside or outside the roll), a wind, a fan-folded source, or any other suitable form. The stock material may be continuous or perforated. The conversion apparatus is operable to drive the stock material in a first direction, which can be an anti-runout direction. The conversion apparatus is fed the stock material from the repository through a drum in an anti-runout direction. The stock material can be any suitable type of protective packaging material including for example other dunnage and void fill materials, inflatable packaging pillows, etc. Some embodiments use supplies of other paper or fiber-based materials in sheet form, and some embodiments use supplies of wound fiber material such as ropes or thread, and thermoplastic materials such as a web of plastic material usable to form pillow packaging material. Examples of paper used include fan folded stock sheets with 30 inch transverse widths and/or 15 inch transverse widths. Preferably these sheets are fan folded as single layers. In other embodiments, the multiple layers of sheets can be fan folded together such that dunnage is made of superimposed sheets that get crumpled together.

The conversion apparatus is used with a cutting mechanism operable to sever the dunnage material. More particularly, the conversion apparatus including a mechanism for cutting or assisting the cutting of the dunnage material at desired lengths is disclosed. In some embodiments, the cutting mechanism is used with no or limited user interaction. For example, the cutting mechanism punctures, cuts, or severs the dunnage material without the user touching the dunnage material or with only minor contact of the dunnage material by the user. Specifically, a biasing member is used to bias the dunnage material against or around a cutting member to improve the ability of the system to sever the dunnage material. The biased position of the dunnage material is used in connection with or separately from other cutting features such as reversing the direction of travel of the dunnage material.

With reference to FIGS. 1A, 1B, 1C, and 2 a dunnage conversion system 10 is disclosed. The dunnage conversion system 10 may include one or more of a supply of stock material 19 and a dunnage apparatus 50. The dunnage apparatus 50 may include one or more of a supply station 13 and a dunnage conversion machine 100. The dunnage conversion machine 100 may include one or more of a converting station 60, a drive mechanism 250, and a support 12. Generally the dunnage conversion system is operable for processing the stock material 19. In accordance with various embodiments, the converting station 60 includes an intake 70 that receives the stock material 19 from a supply station 13. The drive mechanism 250 is able to pull or assist in pulling the stock material 19 into the intake 70. In some embodiments, the stock material 19 engages an shaping member 200 prior to the intake 70. The shaping member 200 may include a central protrusion 210 suitable to cause the stock material 19 to begin curving before entering the intake 70. The drive mechanism 250, in conjunction with edge 112, assists a user in cutting or severing dunnage material 21 at a desired point. The dunnage material 21 is converted from stock material 19, which is itself delivered from a bulk material supply 61 and delivered to the conversion station for converting to dunnage material 21 and then through the drive mechanism 250 and the cutting edge 112.

Figure 1B:
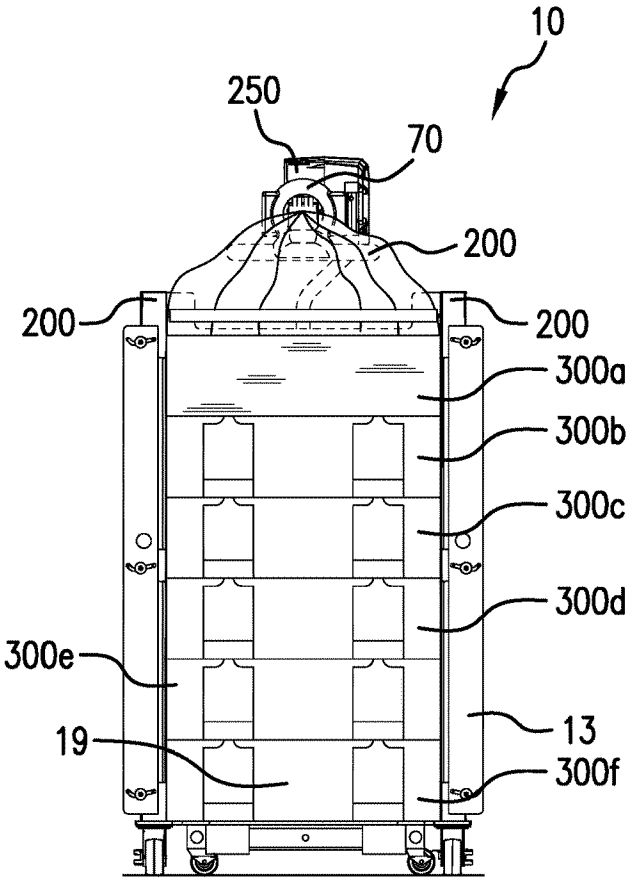
FIG. 1B is a rear view of the embodiment of FIG. 1A of the dunnage conversion system.
Figure 1A:
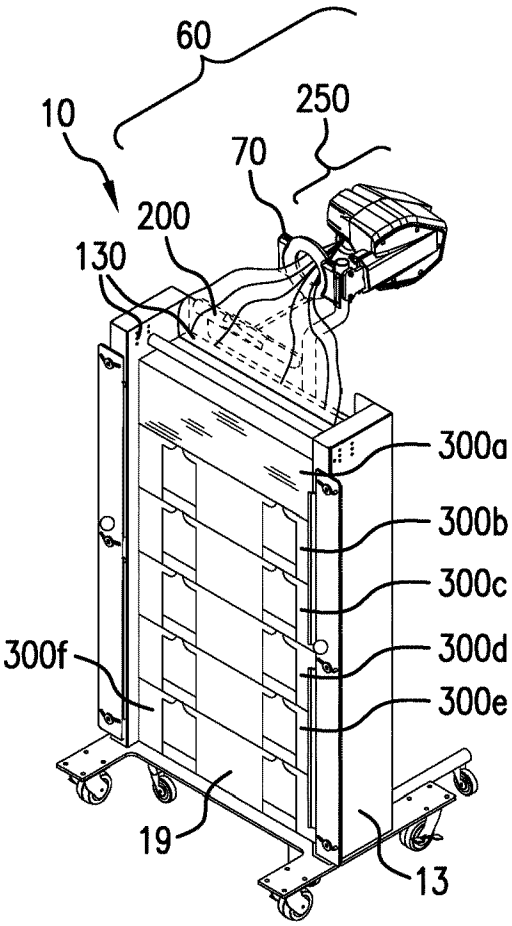
FIG. 1A is a perspective view of an embodiment of a dunnage conversion system.

In accordance with various examples, as shown in FIGS. 1A and 1B, the stock material 19 is allocated from a bulk supply shown as multiple units of stock material 300*a-e*, but can also be a singular unit 300. The stock material 19 can be stored as stacked bales of fan-fold material. However, as indicated above, any other suitable type of supply or stock material may be used. The stock material 19 can be contained in the supply station 13. In one example, the supply station 13 is a cart 34 movable relative to the dunnage conversion system 10. The cart 34 includes side walls 140*a*, 140*b*. The side walls can define 140*a*, 140*b* a magazine 130 suitable to contain multiple units of stock material 300 that the stock material 19 can be pulled from. In other examples, the supply station 13 is not moveable relative to the dunnage conversion system 10. For example, the supply station 13 may be a single magazine, basket, or other container mounted to or near the dunnage conversion system 10.

The stock material 19 is fed from the supply side 61 through the intake 70. The stock material 19 begins being converted from dense stock material 19 to less dense dunnage material 21 by the intake 70 and then pulled through the drive mechanism 250 and dispensed in an anti-runout direction A on the out-feed side 62 of the intake 70. The material can be further converted by the drive mechanism 250 by allowing rollers or similar internal members to crumple, fold, flatten, or perform other similar methods that further tighten the folds, creases, crumples, or other three dimension structure created by intake 70 into a more permanent shape creating the low-density configuration of dunnage material. The stock material 19 can include continuous (e.g. continuously connected stacks, rolls, or sheets of stock material), semi-continuous (e.g. separated stacks or rolls of stock material), or non-continuous (e.g. single discrete or short lengths of stock material) stock material 19 allowing for continuous, semi-continuous or non continuous feeds into the dunnage conversion system 10. Multiple lengths can be daisy-chained together. Further, it is appreciated that various structures of the intake 70 on longitudinal crumpling machines can be used, such as those intakes forming a part of the converting stations disclosed in U.S. Publication No. 2013/0092716, U.S. Publication No. 2012/0165172, U.S. Publication No. 2011/0052875, and U.S. Pat. No. 8,016,735. Examples of cross crumpling machines include U.S. Pat. No. 8,900,111.

In one configuration, the dunnage conversion system 10 can include a support portion 12 for supporting the station. In one example, the support portion 12 includes an inlet guide 70 for guiding the sheet material into the dunnage conversion system 10. The support portion 12 and the inlet guide 70 are shown with the inlet guide 70 extending from the post. In other embodiments, the inlet guide may be combined into a single rolled or bent elongated element forming a part of the support pole or post. The elongated element extends from a floor base configured to provide lateral stability to the converting station. In one configuration, the inlet guide 70 is a tubular member that also functions as a support member for supporting, crumpling and guiding the stock material 19 toward the drive mechanism 250. Other inlet guide designs such as spindles may be used as well.

In accordance with various embodiments, the advancement mechanism is an electromechanical drive such as an electric motor 11 or similar motive device. The motor 11 is connected to a power source, such as an outlet via a power cord, and is arranged and configured for driving the dunnage conversion system 10. The motor 11 is an electric motor in which the operation is controlled by a user of the system, for example, by a foot pedal, a switch, a button, or the like. In various embodiments, the motor 11 is part of a drive portion, and the drive portion includes a transmission for transferring power from the motor 11. Alternatively, a direct drive can be used. The motor 11 is arranged in a housing and is secured to a first side of the central housing, and a transmission is contained within the central housing and operably connected to a drive shaft of the motor 11 and a drive portion, thereby transferring motor 11 power. Other suitable powering arrangements can be used.

The motor 11 is mechanically connected either directly or via a transmission to a drum 17, shown in FIG. 2, which causes the drum 17 to rotate with the motor 11. During operation, the motor 11 drives the drum 17 in either an anti-runout direction or a reverse direction (i.e., opposite of the anti-runout direction), which causes drum 17 to dispense the dunnage material 21 by driving it in the anti-runout direction, depicted as arrows "A" in FIGS. 1C and 2, or withdraw the dunnage material 21 back into the conversion machine in the direction opposite of A. The stock material 19 is fed from the supply side 61 of the intake 70 and over the drum 17, forming the dunnage material 21 that is driven in the anti-runout direction "A" when the motor 11 is in operation. While described herein as a drum, this element of the driving mechanism may also be wheels, conveyors, belts or any other suitable device operable to advance stock material or dunnage material through the system.

In accordance with various embodiments, the dunnage conversion system 10 includes a pinch portion operable to press on the material as it passes through the drive mechanism 250. As an example, the pinch portion includes a pinch member such as a wheel, roller, sled, belt, multiple elements, or other similar member. In one example, the pinch portion includes a pinch wheel 14. The pinch wheel 14 is supported via a bearing or other low friction device positioned on an axis shaft arranged along the axis of the pinch wheel 14. In some embodiments, the pinch wheel can be powered and driven. The pinch wheel 14 is positioned adjacent to the drum such that the material passes between the pinch wheel 14 and the drum 17. In various examples, the pinch wheel 14 has a circumferential pressing surface arranged adjacent to or in tangential contact with the surface of the drum 17. The pinch wheel 14 may have any suitable size, shape, or configuration. Examples of size, shape, and configuration of the pinch wheel may include those described in U.S. Pat. Pub. No. 2013/0092716 for the press wheels. In the examples shown, the pinch wheel 14 is engaged in a position biased against the drum 17 for engaging and crushing the stock material 19 passing between the pinch wheel 14 and the drum 17 to convert the stock material 19 into dunnage material 21. The drum 17 or the pinch wheel 14 is connected to the motor 11 via a transmission (e.g., a belt drive or the like). The motor 11 causes the drum or the pinch wheel to rotate.

In accordance with various embodiments, the drive mechanism 250 may include a guide operable to direct the material as it is passes through the pinch portion. In one example, the guide may be a flange 33 mounted to the drum 17. The flange 33 may have a diameter larger than the drum 17 such that the material is kept on the drum 17 as it passes through the pinch portion.

The drive mechanism 250 controls the incoming dunnage material 19 in any suitable manner to advance it from a conversion device to the cutting member. For example, the pinch wheel 14 is configured to control the incoming stock material. When the high-speed incoming stock material diverges from the longitudinal direction, portions of the stock material contacts an exposed surface of the pinch wheels, which pulls the diverging portion down onto the drum and help crush and crease the resulting bunching material. The dunnage may be formed in accordance with any suitable techniques including ones referenced to herein or ones known such as those disclosed in U.S. Pat. Pub. No. 2013/0092716.

In accordance with various embodiments, the conversion apparatus 10 can be operable to change the direction of the stock material 19 as it moves within the conversion apparatus 10. For example, the stock material is moved by a combination of the motor 11 and drum 17 in a forward direction (i.e., from the inlet side to the anti-runout side) or a reverse direction (i.e., from the anti-runout side to the supply side 61 or direction opposite the anti-runout direction). This ability to change direction allows the drive mechanism 250 to cut the dunnage material more easily by pulling the dunnage material 21 directly against an edge 112. As the stock material 19 is fed through the system and dunnage material 21 it passes over or near a cutting edge 112 without being cut.

Preferably, the cutting edge 112 can be curved or directed downward so as to provide a guide that deflects the material in the out-feed segment of the path as it exits the system near the cutting edge 112 and potentially around the edge 112. The cutting member 110 can be curved at an angle similar to the curve of the drum 17, but other curvature angles could be used. It should be noted that the cutting member 110 is not limited to cutting the material using a sharp blade, but it can include a member that causes breaking, tearing, slicing, or other methods of severing the dunnage material 21. The cutting member 110 can also be configured to fully or partially sever the dunnage material 21.

In various embodiments, the transverse width of the cutting edge 112 is preferably about at most the width of the drum 17. In other embodiments, the cutting edge 112 can have a width that is less than the width of the drum 17 or greater than the width of the drum 17. In one embodiment, the cutting edge 112 is fixed; however, it is appreciated that in other embodiments, the cutting edge 112 could be moveable or pivotable. The edge 112 is oriented away from the driving portion. The edge 112 is preferably configured sufficient to engage the dunnage material 21 when the dunnage material 21 is drawn in reverse. The edge 112 can comprise a sharp or blunted edge having a toothed or smooth configuration, and in other embodiments, the edge 112 can have a serrated edge with many teeth, an edge with shallow teeth, or other useful configuration. A plurality of teeth are defined by having points separated by troughs positioned there between.

Generally, the dunnage material 21 follows a material path A as shown in FIG. 1C. As discussed above, the material path A has a direction in which the material 19 is moved through the system. The material path A has various segments such as the feed segment from the supply side 61 and severable segment 24. The dunnage material 21 on the out-feed side 62 substantially follows the path A until it reaches the edge 112. The edge 112 provides a cutting location at which the dunnage material 21 is severed. The material path can be bent over the edge 112.

As discussed above, any suitable stock material may be used. For example, the stock material may have a basis weight of about at least 20 lbs., to about, at most, 100 lbs. The stock material 19 comprises paper stock stored in a high-density configuration having a first longitudinal end and a second longitudinal end that is later converted into a low-density configuration. The stock material 19 is a ribbon of sheet material that is stored in a fan-fold structure, as shown in FIG. 1A, or in coreless rolls. The stock material is formed or stored as single-ply or multiple plies of material. Where multi-ply material is used, a layer can include multiple plies. It is also appreciated that other types of material can be used, such as pulp-based virgin and recycled papers, newsprint, cellulose and starch compositions, and poly or synthetic material, of suitable thickness, weight, and dimensions.

In various embodiments, the stock material units may include an attachment mechanism that may connect multiple units of stock material (e.g., to produce a continuous material feed from multiple discrete stock material units). Preferably, the adhesive portion facilitates daisy-chaining the rolls together to form a continuous stream of sheet material that can be fed into the converting station 60.

Generally, the stock material 19 may be provided as any suitable number of discrete stock material units. In some embodiments, two or more stock material units may be connected together to provide a continuous feed of material into the dunnage conversion machine that feeds through the connected units, sequentially or concurrently (i.e., in series or in parallel). Moreover, as described above, the stock material units may have any number of suitable sizes and configurations and may include any number of suitable sheet materials. Generally, the term "sheet material" refers to a material that is generally sheet-like and two-dimensional (e.g., where two dimensions of the material are substantially greater than the third dimension, such that the third dimension is negligible or de minimus in comparison to the other two dimensions). Moreover, the sheet material is generally flexible and foldable, such as the example materials described herein.

In some embodiments, the stock material units may have fanfold configurations. For example, a foldable material, such as paper, may be folded repeatedly to form a stack or a three-dimensional body. The term "three-dimensional body," in contrast to the "two-dimensional" material, has three dimensions all of which are non-negligible. In an embodiment, a continuous sheet (e.g., sheet of paper, plastic, or foil) may be folded at multiple fold lines that extend transversely to a longitudinal direction of the continuous sheet or transversely to the feed direction of the sheet. For example, folding a continuous sheet that has a substantially uniform width along transverse fold lines (e.g., fold lines oriented perpendicularly relative to the longitudinal direction) may form or define sheet sections that have approximately the same width. In an embodiment, the continuous sheet may be folded sequentially in opposite or alternating directions to produce an accordion-shaped continuous sheet. For example, folds may form or define sections along the continuous sheet, which may be substantially rectangular.

For example, sequentially folding the continuous sheet may produce an accordion-shaped continuous sheet with sheet sections that have approximately the same size and/or shape as one another. In some embodiments, multiple adjacent section that are defined by the fold lines may be generally rectangular and may have the same first dimension (e.g., corresponding to the width of the continuous sheet) and the same second dimension that is generally along longitudinal direction of the continuous sheet. For example, when the adjacent sections are contacting one another, the continuous sheet may be configured as a three-dimensional body or a stack (e.g., the accordion shape that is formed by the folds may be compressed, such that the continuous sheet forms a three-dimensional body or stack).

It should be appreciated that the fold lines may have any suitable orientation relative to one another as well as relative to the longitudinal and transverse directions of the continuous sheet. Moreover, the stock material unit may have transvers folds that are parallel one to another (e.g., compressing together the sections that are formed by the fold lines may form a three-dimensional body that is rectangular prismoid) and may also have one or more folds that are non-parallel relative to the transvers folds.

Folding the continuous sheet at the transvers fold lines forms or defines generally rectangular sheet sections. The rectangular sheet sections may stack together (e.g., by folding the continuous sheet in alternating directions) to form the three-dimensional body that has longitudinal, transverse, and vertical dimensions. As described above, the stock material from the stock material units may be fed through the intake 70 (FIGS. 1A, 1B, 2A, 2B and 3). In some embodiments, the transverse direction of the continuous sheet (e.g., direction corresponding to the transverse dimension 302 (see, e.g., FIGS. 6A and 7A)) is greater than one or more dimensions of the intake 70. For example, the transverse dimension of the continuous sheet may be greater than the diameter of a generally round intake. For example, reducing the width of the continuous sheet at the start thereof may facilitate passage thereof into the intake. In some embodiments, the decreased width of the leading portion of the continuous sheet may facilitate smoother entry and/or transition or entry of a daisy-chained continuous sheet and/or may reduce or eliminate catching or tearing of the continuous sheet. Moreover, reducing the width of the continuous sheet at the start thereof may facilitate connecting together or daisy-chaining two or more stock material units. For example, connecting or daisy-chaining material with a tapered section may require smaller connectors or splice elements than for connecting a comparable sheet of full width. Moreover, tapered sections may be easier to manually align and/or connect together than full-width sheet sections.

As indicated above, the dunnage apparatus 50 may include one or more of a supply station 13 and a dunnage conversion machine 100 (as shown in FIGS. 1A-1C and 2A-2C). In accordance with various embodiments, the supply station 13 is any structure suitable to support the stock material 19 and allow the material to be drawn into the intake 70. The dunnage conversion machine 100 may include one or more of a converting station 60 and a support 12.

In accordance with various embodiments, the converting station 60 pulls the stock dunnage from supply station 13 and begins to deform the stock dunnage into a more dense configuration. The material, crumpled by entering the converting station, is pulled by and into the drive mechanism 250 where the drum 17 further compresses the crumpled material. This allows the crumpled material to be set by forming creases along the crumpled areas allowing the material to hold its crumpled form. In accordance with various embodiments, the converting station 60 includes a dunnage intake 70. The dunnage intake 70 receives the dunnage material along path A (see FIGS. 1A-C and 2A-C).

Figure 3:
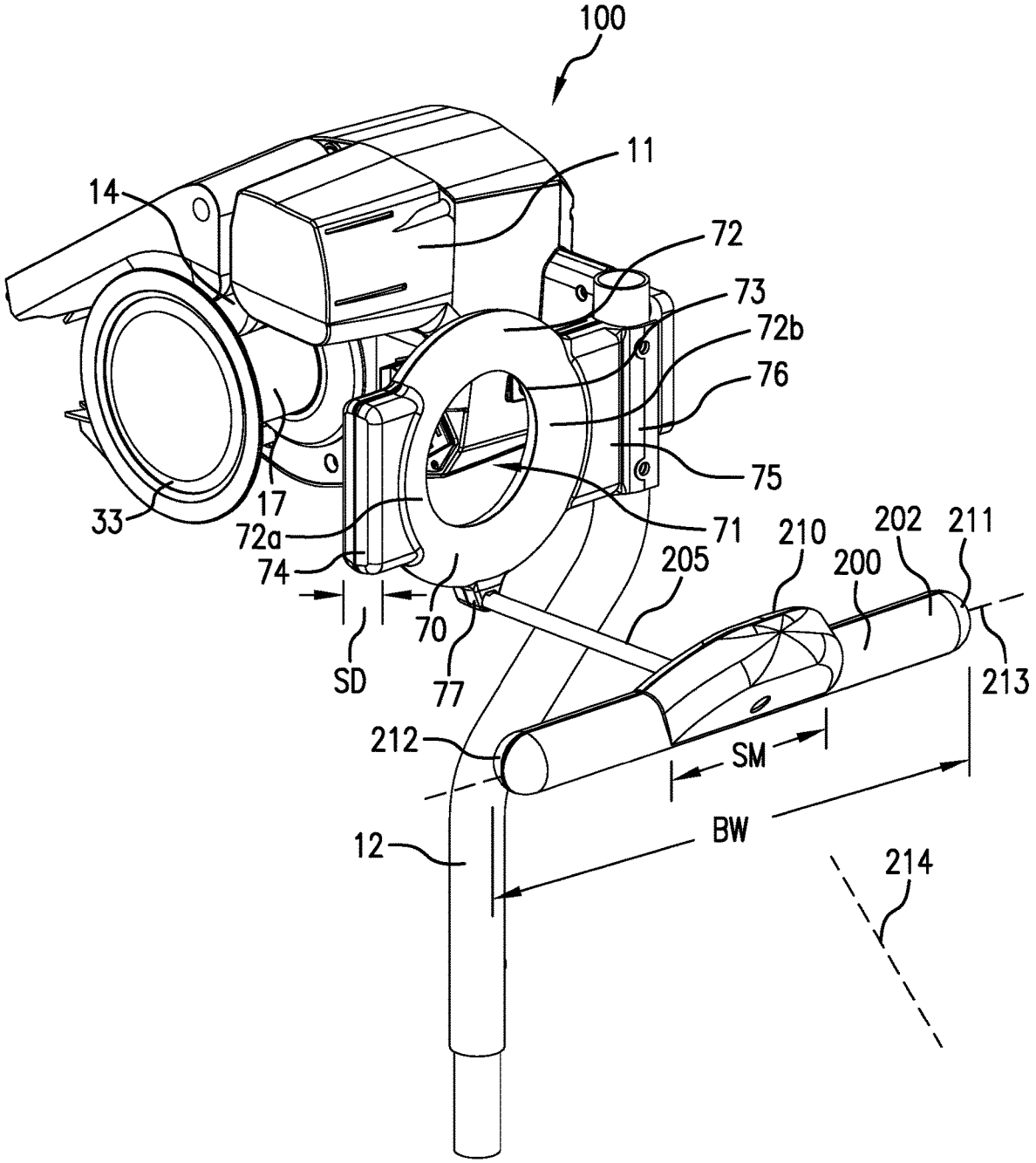
FIG. 3 is a perspective view of part of the embodiment of the dunnage conversion machine of FIGS. 1A-2C.
Figure 4C:
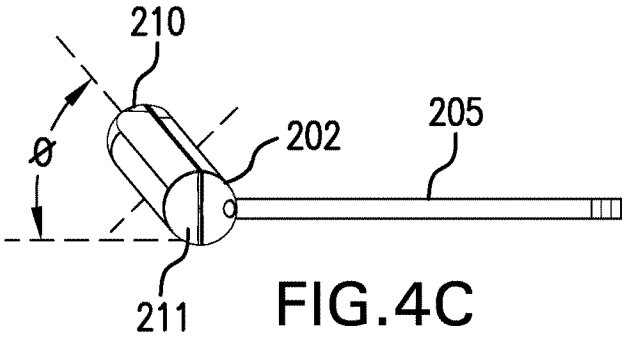
FIG. 4C is a left side view of the embodiment of the shaping member of FIG. 3.
Figure 4D:
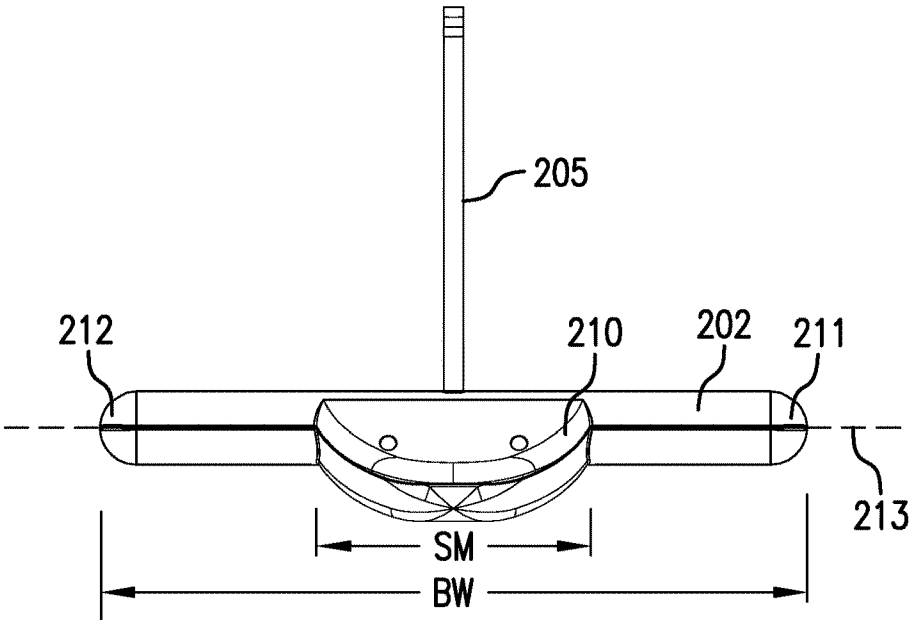
FIG. 4D is a top view of the embodiment of the shaping member of FIG. 3.
Figure 4A:
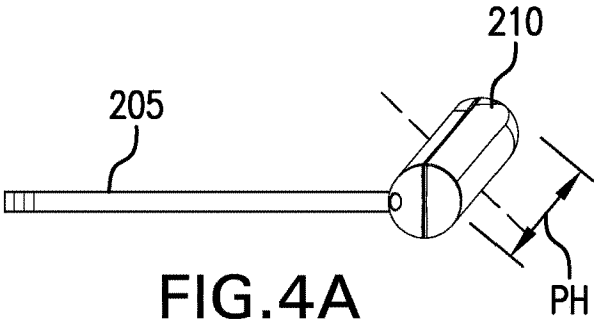
FIG. 4A is a right side view of the embodiment of the shaping member of FIG. 3.
Figure 4B:
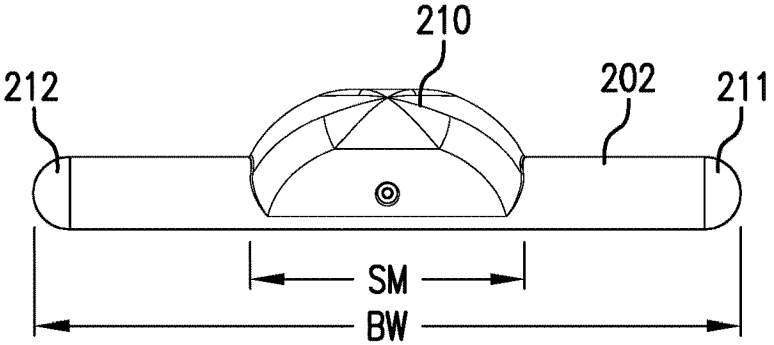
FIG. 4B is a rear view of the embodiment of the shaping member of FIG. 3.
Figure 5:
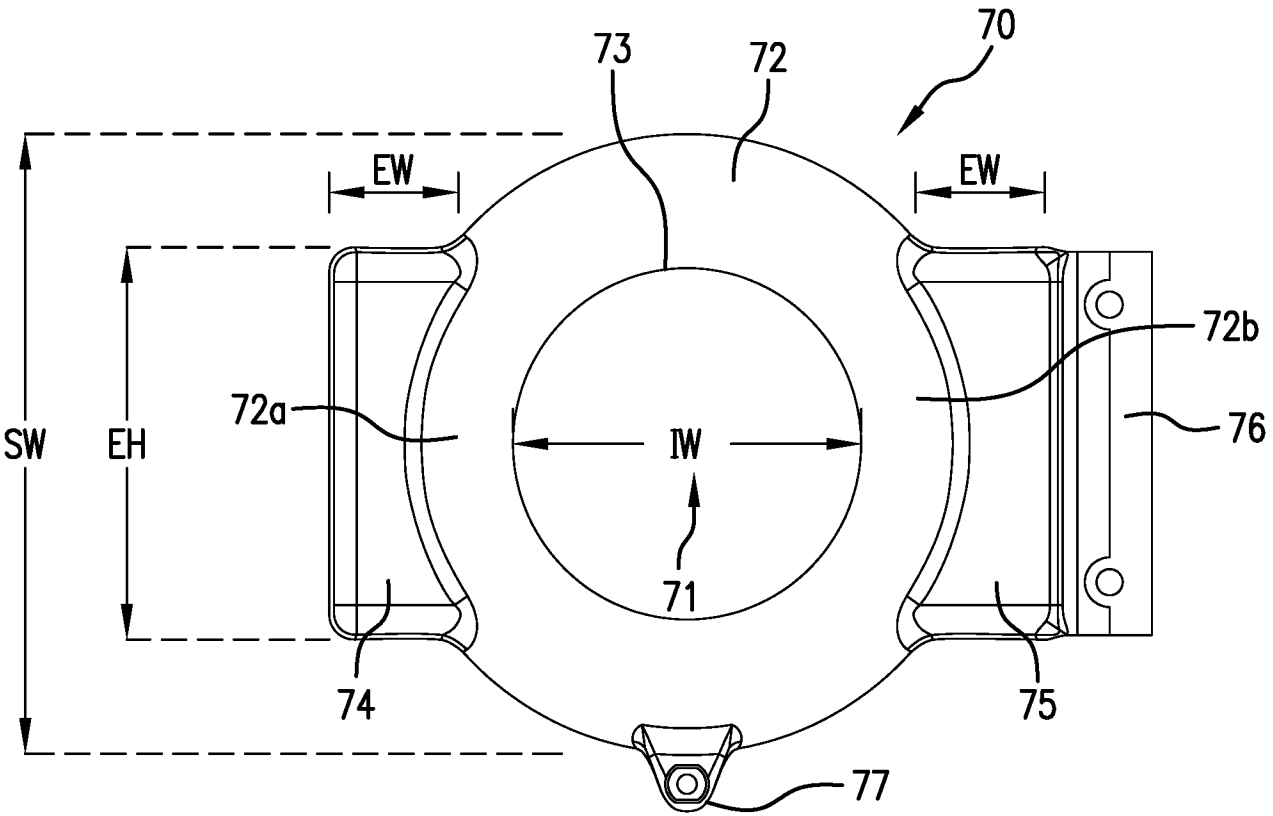
FIG. 5 is a rear view of the embodiment the intake of FIG. 3.

As illustrated in FIGS. 3 and 5, the dunnage intake member 70 includes an inlet 71 that constricts stock material as the stock material is pulled into and through the dunnage intake member. The inlet 71 is defined by an outer support member 72 that forms an outer barrier suitable to engage and compress the stock material 19 inwardly into a more dense configuration. Preferably the outer support member 72 includes transverse portions that can engage and compress the stock material 19 inwardly. In such examples, the outer support member 72 is located on at least the transverse sides of the path of the stock material through the converting station 60. In various examples, the outer support member 72 forms the outer perimeter of an opening that defines the inlet 71. In some embodiments, the outer support member 72 is not fully closed (i.e., forming a u-shape or similar design). In some embodiments, the outer support member 72 forms a full perimeter but is not connected (i.e., forming a spiral or similar design). In some embodiments, the outer support member 72 forms a fully closed and connected outer perimeter. In one example, the outer support member 72 is a continuous ring. While shown as round, other shapes and designs are also suitable to constrict the stock material to dunnage material.

In accordance with various embodiments, the dunnage intake member 70 may also include one or more support members (e.g., 74, 75) forming a barrier on one or more sides of the dunnage intake member 70. The support members (e.g., 74, 75) are placed on the sides of the intake member based on the direction the stock material is received into the intake member 70. For example, the support members (e.g., 74, 75) are positioned exterior of the intake member 70 consistent with the transverse direction of the stock material as the stock material is received into the intake member 70. In this way, the transverse support member (e.g., 74, 75) limits tendency of the stock material from wrapping around the intake member 70 support 72 as the stock material 19 is drawn into the inlet 71. In one example, the intake member 70 includes support members 74, 75 extending outwardly from the support 72 on the transverse sides of the support member 72*a*, 72*b*. In one example, the support members 74, 75 form ears extending from the sides of the support 72. In this way, the ears limit the ability of stock material 19 to wrap around the outside of the support 72 and thereby the ears limit the likelihood of the stock material 19 tearing as it is pulled through the inlet 71. The ears also protrude transversely from the support 72 with minimal to no structure extending upstream of the support 72. This allows for support (i.e., anti-wrapping) in the transverse direction without significantly restraining the stock material transversely in an upstream direction of the support 72.

In accordance with one embodiment, the intake 70 includes a support 72 formed as a doughnut. The interior of the support is an aperture with rounded edges 73 that define the inlet 71. The rounded edges 73 allow for a smooth transition of the stock material 19 through the inlet 71, thereby limiting tearing. Transverse supports 74 and 75 may extend as ears from the transverse sides 72*a* and 72*b* of the support 72. As used herein, the ears are the transverse supports 74 and 75 protruding from the support 72 that have a height EH that is less than the height of the support 72. The height EH represents the height of the supports 74 and 75 at the sides of the support 72. In various embodiments, the height EH is greater than the width IW of the inlet 71 but less than the total height SW of the support 72. In accordance with various embodiments, the transverse supports 74 and 75 may have a width EW that extends from the outside of the support 72. The width EW represents the increase in the size of the barrier formed on the transverse ends of the intake due to the transverse supports 74 and 75. For example, the transverse sides of the intake provide a greater barrier than the top or bottom of the intake. In an alternative example, if the orientation of the stock material changed such that the stock material entered the intake with the transverse width of the stock material going up and down relative to the intake, then the supports 74 and 75 would be positioned at the top and bottom of support 72. The width EW may between ½ and 1½ times the width of the support 72. In this way the barrier formed by the supports 74 or 75 is between 1½ and 2½ times bigger than the barrier formed by only the support 72.

In accordance with various embodiments, the dunnage intake 70 may be supported by a stand 12. The intake 70 may be directly mounted to the stand 12, to the drive mechanism 250, or to an intermediate member. In one example, support 75 includes an attachment bracket that mounts to the stand 12. By mounting the intake 70 to the stand directly or via support 75, the intake 70 is more rigidly positioned and therefore better able to handle the forces caused by the crumpling of the stock material at the inlet 71.

In accordance with various embodiments, the converting station 60 includes a dunnage shaping member 200. The shaping member 200 receives the dunnage material along path A (see FIGS. 1A-C and 2A-C) and manipulates the path of the stock material in a way that causes the stock material to begin to bend or curl prior to being pulled into the intake. The stock material flows in a longitudinal direction up and around one or more portions of the shaping member 200. The shaping member 200 is positioned upstream of the intake 70. For example the shaping member 200 may be positioned between the intake 70 and the supply station 13 such that as the stock material 19 flows longitudinally downstream from the supply station, it slides around the shaping member 200, allowing the shaping member 200 to manipulate the shape of the stock material 19 prior to entering the inlet 71 of the intake 70. The shaping member 200 bends the stock material 19 in one or more directions as the stock material is pulled from the supply station 13. For example, the shaping member 200 can bend the stock material around one or both of a transverse axis 213 and a longitudinal axis 214.

As illustrated in FIGS. 3 and 4A-4D, the shaping member 200 includes a support structure 202 and central protrusion 210. In accordance with various embodiments, the support structure 202 extends across at least a portion of path A of the stock material 19. (FIGS. 1A-C and 2A-C illustrate an example of path A with the material following there along and FIGS. 3 and 4A-D illustrate path A without additionally showing the material.) For example, the support structure may extend transversely across this path or be substantially parallel to an axis 213 that is generally perpendicular to the longitudinal path A. As path A may curve, the axis 213 may also be perpendicular to each point along path A between the supply station 13 and the intake 70. The support structure 202 is any suitable structure that can support the forces resulting from the stock material 19 being pulled from the supply station 13 and into the intake 70. Specifically, the support structure 202 can change the direction of the stock material 19 as it passes across the support structure 202.

In accordance with some embodiments, the support structure 202 may be a bar as shown in FIGS. 3 and 4A-D. As shown, the bar can be generally cylindrical, forming a rod, but in alternative embodiments, the bar can be other shapes suitable to support and shape the stock material along its path. The support structure 202 may extend between transverse ends 211 and 212. In some examples, the bar may be curved, but in a preferred example the bar is substantially straight. In various embodiments, the ends 211, 212 may be free ends (i.e., not connected to any other structure). The free ends 211, 212 may allow stock material of sufficient width to curl around the free ends. Such a configuration further allows the stock material to curl prior to entering/being pulled through the intake 70. In various examples, the free ends 211, 212 are rounded such that they are operable to allow the stock material to move past the support structure 202 without snagging or tearing thereon.

In some embodiments, the stock material 19 may glide over the shaping member 200 without hanging off the free ends 211, 212, (i.e., the shaping member 200 is wider than the transverse width of the stock material 19 and the support structure 202 extends across at least the full width of the stock material). In other embodiments, the stock material 19 may glide over the shaping member 200 while hanging off of the free ends 211, 212, (i.e., the shaping member 200 is narrower than the transverse width of the stock material 19 and the support structure 202 extends across less than a full width of the stock material 19). In accordance with these examples, the shaping member 200 is wider than the inlet 71. Thus the shaping member 200 begins a large curl that is further restricted by the inlet 71 as the stock material passes therethrough. In accordance with various examples, the shaping member 200 is between about 2 and 8 times wider than the inlet 71. Preferably the shaping member 200 is about 4 times wider than the inlet 71.

As illustrated in FIGS. 3 and 4A-4D, the shaping member 200 can also include a central protrusion 210 that extends away from the support structure 202. The central protrusion 210 is located on the support structure 202 in such a way as to cause the stock material 19 to bend around a longitudinal axis (e.g., axis 214) as the stock material 19 moves across the shaping member. This bend around the longitudinal axis is referred to as the longitudinal bend. The longitudinal axis (e.g. axis 214) is the axis running parallel to the path A of the material at any particular point that is also located along the center or near to the center of the central protrusion 210. As the stock material 19 bends around the transverse axis 213, it should be noted that path A is not necessarily linear. However, the path A may be defined by a series of longitudinal axes that follow the path A (i.e., are parallel and tangential to the path). As path A curves, the direction of the longitudinal axis (e.g., 214) may change, while still remaining parallel at each subsequent point along the path. The longitudinal axis may also remain generally perpendicular to the transverse axis 213. The term perpendicular is used herein as being applicable in situations where the longitudinal axis and the transverse axis intersect and also where they are skew with respect to one another. As such, The central protrusion 210 may cause the stock material 19 to bend about a longitudinal axis, while the support member 202 may cause the stock material to bend about a transverse axis. The transverse bend may direct the stock material at the intake 70 while the longitudinal bend may begin to curl the material prior to entering the intake 70. This pre-curl action can limit the likelihood of the intake 70 tearing the stock material 19 as the stock material is crumpled down in size by passing through the intake 70.

In accordance with various embodiments, the relationship between the support structure 202 and the central protrusion 210 may be such that the central protrusion 210 protrudes more deeply into the stock material 19, thereby forming the longitudinal bend about the central protrusion 210. In accordance with various embodiments, the central protrusion extends radially from the support structure. This radial extension may be in a single direction as shown in FIGS. 3 and 4A-4D, or in multiple directions, or it may extend away from the support structure all the way around (i.e., 360 around) the support structure 202.

In accordance with embodiments in which the radial extension extends in a single direction or in a limited range of directions, the central protrusion may be a single post extending outwardly, a wall extending outwardly, or a structure that extends outwardly in multiple directions. As shown by way of example in FIGS. 4A-4D, the central protrusion 210 is a transverse wall extending from support structure 202. As shown, the transverse wall is a semi-circular protrusion. In various examples, the axis 215 of the semi-circular protrusion is skew with but perpendicular to the transverse axis 213. This axis may also define the longitudinal axis 214 or some portion of the longitudinal axis as the longitudinal bend is about this axis. As indicated above, in one example, the radial extension may be a single post having negligible width compared to the width of the support structure 202. In such examples, however, the width is sufficient to prevent tearing or cutting of the stock material by the post. In other examples, the transverse wall extending from support structure 202 may have a width between about ¼ and ½ of the length of the support structure 202. Preferably, the transverse wall extending from support structure 202 may have a width between about ⅓ and ½ of the length of the support structure 202. In this range, the wall may allow for a smooth longitudinal bend in the stock material 19 that allows the stock material to be more smoothly received into the intake 70.

Generally, the shaping member 200 manipulates the path of the stock material in a way that causes the stock material to begin to bend or curl prior to being pulled into the intake member. While the support structure 202 may form a transverse bend and the central protrusion 210 may form a longitudinal bend, the combination of the two may begin to bend or curl the stock material and direct it toward the intake 70 to begin the conversion of the stock material 19 to the dunnage material 21.

As discussed above, a variety of stock material products may be used. However, the central protrusion 210 may be configured to form the longitudinal bend that is suitable to minimize tearing upon entry into the intake 70. Depending on the width or the stiffness of the stock material 19, the central protrusion 210 may have a different length. In one example, the central protrusion 210 extends away from the shaping member a distance PH between about 1/10 and 1/2 of the length of the support structure. Conversion systems that process narrower stock material (e.g., 15 inch wide) may be closer to between 1/10 and 1/4 of the length of the support structure, whereas conversion systems that process wider stock material (e.g., 30 inch wide) may be closer to between 1/8 and 1/2 of the length of the support structure 202. Some conversion systems may process both wider stock material and narrower stock material. In these systems the PH may be between 1/10 and 1/4 of the length of the support structure 202 or, more preferably, about 1/8 of the length of the support structure 202.

The central protrusion 210 may be generally centered on at least one of the paths of the stock material 19 or the support member 202. Preferably the support member 202 is also centered on the path of the stock material 19 as it flows longitudinally downstream from the supply 13 to the intake 70. In accordance with various embodiments, the central protrusion 210 also extends generally away from both the drive mechanism 250 and a source of the stock material (e.g., supply station 13). For example, the central protrusion 210 extends rearwardly from the support member 202 at an angle Θ. In one embodiment, Θ is between about 15° and 75° off a horizontal plane passing through a center axis of the support structure 202. Preferably, Θ is between about 35° and 55° off a horizontal plane passing through a center axis of the support structure 202. More preferably, Θ is about 45° through a center axis of the support structure 202. At this angle, the stock material engages the central protrusion symmetrically from the supply side and also from the intake side. This allows for an even force between the shaping member and the stock material where the longitudinal and transverse bends are formed and the stock material extends in two directions (i.e. upstream and downstream) from the shaping member.

In accordance with various embodiments, the shaping member 200 is located upstream of the intake 70. The stock material may generally flow unencumbered between the two devices. In some embodiments space between the two devices may be included to keep user hands and fingers out of the system. The two devices may be connected directly to one another, they may each be connected to the stand 12, or one or both may be cantilever out from the drive mechanism 250. In one example, the intake 70 may be connected to the stand 12 as discussed above, and the shaping member 200 may be cantilevered out away from the intake 70 via a connection member 205. The connection member 205 may directly connect the intake 70 and the shaping member 200. The connection member 205 may set the distance between the two devices. This distance is preferably one that allows for a continuous curl from the shaping member 200 to the intake 70, allowing for smooth transition of the stock material 19 through the intake 70, i.e., limited or no tearing.

Figure 2C:
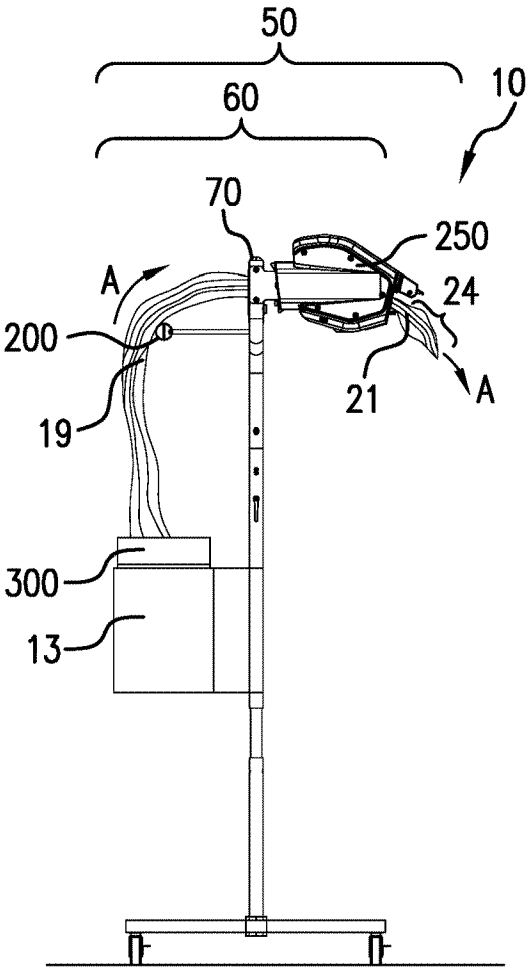
FIG. 2C is a side view of the embodiment of FIG. 2A of the dunnage conversion system.
Figure 2B:
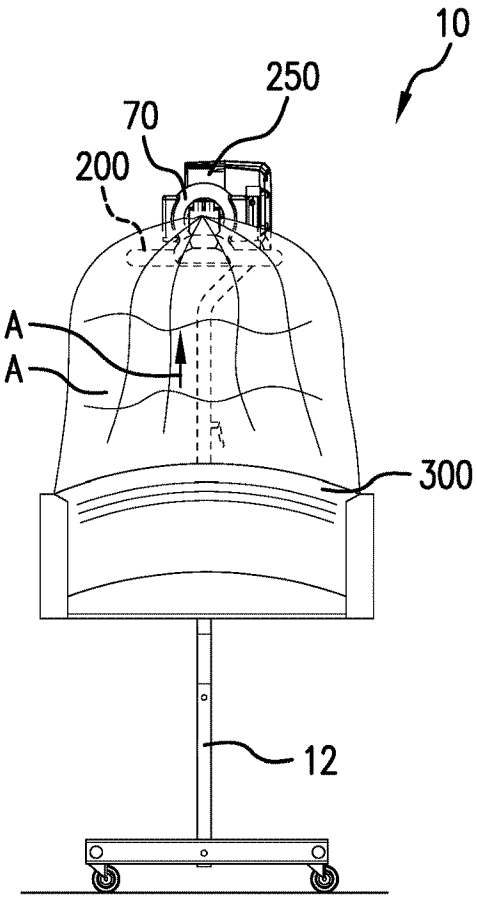
FIG. 2B is a rear view of the embodiment of FIG. 2A of the dunnage conversion system.
Figure 2A:
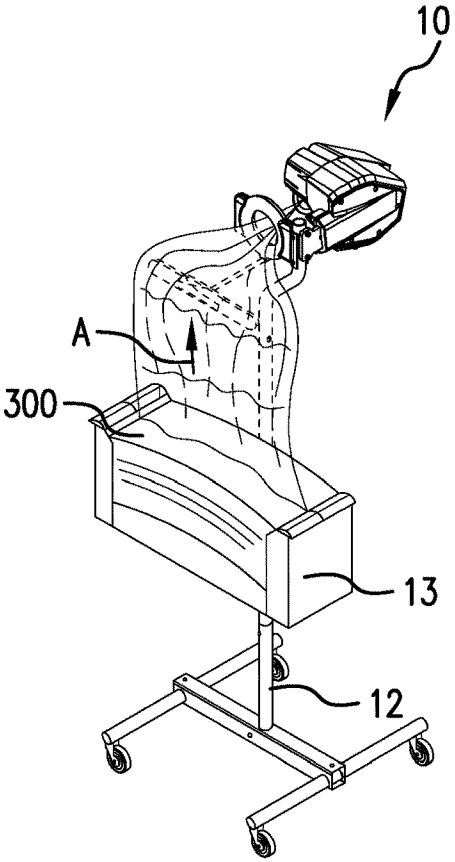
FIG. 2A is a perspective view of another embodiment of a dunnage conversion system.

For example, the supply station 13 can be any suitable surface for holding the stock material 19 in single bundles, in multiple daisy chained bundles, in a flat configuration, or in a curved configuration. In various examples, as illustrated in FIGS. 1A-1C, the supply station 13 is a cart 34 that is separately movable relative to the dunnage conversion machine 100. In various other examples, as illustrated in FIGS. 2A-2C, the supply station 13 is mounted in a basket or similar support to the dunnage conversion machine 100. For example, the supply station 13 may be mounted to the dunnage conversion machine 100 via a support portion, such as the stand 12. In such embodiments, the dunnage conversion machine 100 and the supply station 13 do not move relative to one another. In other embodiments, the supply station 13 and the dunnage conversion machine 100 may be fixed relative to one another but not mounted to each other, or the supply station 13 and the dunnage conversion machine 100 may move relative to one another while being mounted together. Regardless, the supply station may support the stock material 19 in one or more units. FIGS. 1A-1C illustrate the supply station 13 supporting a plurality of stock material units, e.g., units 300*a*, 300*b*, 300*c*, 300*d*, 300*e* and/or 300*f*. FIGS. 2A-2C illustrate the supply station 13 supporting a single stock material unit 300. It should be noted, however, that support member 220 may support a plurality of units and/or the cart 34 may support a single unit. Each of the stock material units 300*a*, 300*b*, 300*c*, 300*d*, 300*e* and/or 300*f* may be placed into the supply station 13 individually and subsequently may be connected together after placement. Hence, for example, each of the stock material units 300*a*, 300*b*, 300*c*, 300*d*, 300*e* and/or 300*f* may be suitability sized to facilitate lifting and placement thereof by an operator. Moreover, any number of stock material units may be connected or daisy-chained together. For example, connecting together or daisy-chaining multiple stock material units may produce a continuous supply of material.

As described above, the dunnage conversion machine may include a supply station (e.g., supply station 13 (FIGS. 1A-1C)). For example, each of the stock material units 300 may be placed into the supply station individually and subsequently may be connected together after placement. Hence, for example, each of the stock material units 300*a*-300*e* may be suitably sized to facilitate lifting and placement thereof by an operator. Moreover, any number of stock material units may be connected or daisy-chained together. For example, connecting together or daisy-chaining multiple stock material units may produce a continuous supply of material. A continuous sheet may be repeatedly folded in opposing directions, along transverse fold lines, to form sections or faces along the longitudinal direction of the continuous sheet, such that adjacent sections may fold together (e.g., accordion-like) to form the three-dimensional body of each of the stock material units 300.

The stock material units may include one or more straps that may secure the folded continuous sheet (e.g., to prevent unfolding or expansion and/or to maintain the three-dimensional shape thereof). For example, strap assemblies 500 may wrap around the three-dimensional body of the stock material unit, thereby securing together the multiple layers or sections (e.g., formed by accordion-like folds). The strap assemblies 500 may facilitate storage and/or transfer of the stock material unit (e.g., by maintaining the continuous sheet in the folded and/or compressed configuration).

For example, when the stock material unit 300 is stored and/or transported, wrapping the three-dimensional body of the stock material unit 300 and/or compressing together the layers or sections of the continuous sheet that defines the three-dimensional body may reduce the size thereof. Moreover, compressing together the sections of the continuous sheet may increase rigidity and/or stiffness of the three-dimensional body and/or may reduce or eliminate damaging the continuous sheet during storage and/or transportation of the stock material unit 300.

Figure 6:
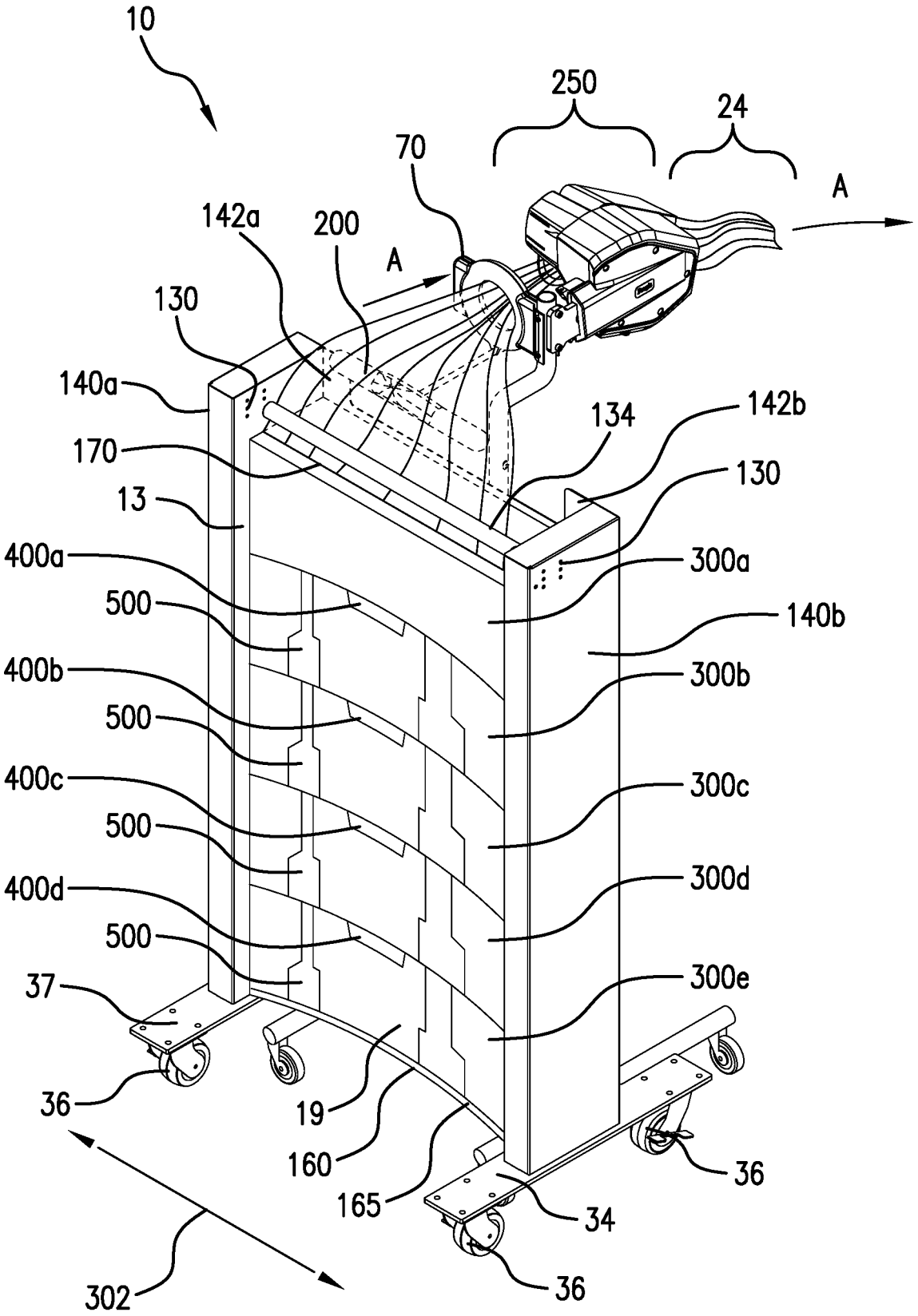
FIG. 6 is a rear isometric view of a dunnage system with curved support for daisy chained stock material.

Generally, the strap assemblies 500 may be positioned at any number of suitable locations along the transverse dimension of any of the stock material units 300. In the illustrated embodiment, the strap assemblies 500 are positioned on opposite sides of the unit. In some embodiments, and as illustrated in FIG. 6, another stock material unit may be placed on top of each of the stock material units with 300*a* shown on top of 300*b*, such that the bottom section and/or portion of the continuous sheet of unit 300*a* contacts the exposed portion(s) of the stock material unit 300*b*. Generally, stock material units may be similar to or the same as one another. Moreover, a connector of a splice member that is included with the stock material unit 300*a* may be attached to the stock material unit 300*b*. For example, the connector adhesive layer of the connector that is attached to the stock material unit 300*b* may face outward or upward.

Moreover, as mentioned above, the stock material unit 300*b* may be the same as the stock material unit 300*a*. For example, the stock material unit 300*b* may include a connector that may be oriented to have an adhesive thereof face upward or outward. Hence, an additional stock material unit may be placed on top of the stock material unit 300*b*, such as to connect together the continuous sheet of the stock material unit 300*b* with the continuous sheet of another stock material unit (e.g. unit 300*a*). In such manner, any suitable number of stock material units may be connected together and/or daisy-chained to provide a continuous feed of stock material into the dunnage conversion machine.

In some embodiments, as discussed in detail above, the stock material unit 300 may be bent or have an arched shape. For example, unit 300*e* may be bent while unit 300*a* is flat. In some examples all units are bent or in other examples no units are bent. In the illustrated embodiment of FIG. 6, the stock material units 300*a-d* include splice members 400*a-d*. The stock material units 300*a-d* may be bent in the manner that protrudes the connector of the splice member 400*a* outward relative to other portions of the stock material units 300*a-d*. The splice member 400*a* is configured to daisy chain unit 300*a* to unit 300*b*. The splice member 400*b* is configured to daisy chain unit 300*b* to unit 300*c*. The splice member 400*c* is configured to daisy chain unit 300*c* to unit 300*d*. The splice member 400*d* is configured to daisy chain unit 300*d* to unit 300*e*. In some examples, the stock material units may be bent after placement into the supply station 13 (e.g., the supply station may include an anti-runout mechanism 160 as discussed above. Stacking or placing another, additional stock material unit on top of the bent stock material unit may facilitate contacting the adhesive layer of the connector with the continuous sheet of the additional stock material unit. After the additional stock material is placed on top of the lower stock material unit, the additional stock material unit may conform to the shape of the lower stock material unit. The conforming may be complete (i.e. the upper unit may completely adapt the shape of the lower unit) or the conforming may be partial (i.e. the upper unit slightly conforms to the lower unit but remains flatter than the lower unit.)

The strap assemblies 500 may be spaced from each other along a traverse direction of the three-dimensional body of the stock material units. For example, the strap assemblies may be spaced from each other such that the center of gravity of the three-dimensional body is located between two strap assemblies 500. Optionally, the strap assemblies 500 may be equidistantly spaced from the center of gravity.

As described above, the stock material units 300*a-e* (or in some embodiments one unit 300 is used) may be placed into a dunnage conversion machine 100 forming the dunnage system 50. Additionally or alternatively, multiple stock material units (e.g., similar to or the same as the stock material unit 300) may be stacked on top of another in the dunnage conversion machine. The stock material unit may include one or more strap assemblies 500. For example, the strap assemblies 500 may remain wrapped about the three-dimensional bodies of the stock material units after placement and may be removed thereafter (e.g., the strap assemblies 500 may be cut at one or more suitable locations and pulled out).

Furthermore, it should be appreciated that, generally, the three-dimensional body of any of the stack material units described herein may be, stored, transported, used in a dunnage conversion machine, or combinations thereof without any wrapping (or strapping) or with more or different straps or wrappings than the strap assemblies discussed herein. For example, a twine, paper, shrink-wrap, and other suitable wrapping or strapping material may secure together one or more sheets that define the three-dimensional body of any of the stock material unit described herein. Similarly, the above-described method and structure of supporting the three-dimensional body of the stock material unit may facilitate wrapping or three-dimensional body with any number of suitable wrapping or strapping materials and/or devices. Further details of the strap assemblies 500 and the daisy chaining splice elements 400 are disclosed in application Ser. No. 15/593,007, entitled Stock Material Units For A Dunnage Conversion Machine filed concurrently herewith, which is incorporated by reference in its entirety.

By utilizing the strap assemblies 500 or similar banded wrapping, the units of stock material 300 are not forced into a transversely rigid configuration. Thus the strap assemblies 500 allow the units of stock material 300 to be transversely flexible or without transversely rigid support, thereby permitting the units of stock material 300 arch/sag or otherwise flex into a transversely nonplanar configuration.

The supply station 13 is configured to receive fanfold stock material 19 and manipulate the fanfold stock material 19 into being withdrawn from the supply station 13 in a non-planar configuration. The supply station 13 is associated with the dunnage conversion machine 100 such that the dunnage conversion machine 100 operably draws fanfold stock material 19 from the top of a stack 300 of fanfold stock material. The non-planar configuration of the stock material 19 limits the tendency for the material to blow away/runout when exposed to significant air currents. In accordance with various embodiments, the various embodiments of the converting station 60 disclosed herein may be combined with the anti-runout configurations of a supply station and support 160. Further details of the support 160 are disclosed in application Ser. No. 15/593,078, entitled Wind-Resistant Fanfold Supply Support filed concurrently herewith, which is incorporated by reference in its entirety.

One having ordinary skill in the art should appreciate that there are numerous types and sizes of dunnage for which there can be a need or desire to accumulate or discharge according to an exemplary embodiment of the present invention. As used herein, the terms "top," "bottom," and/or other terms indicative of direction are used herein for convenience and to depict relational positions and/or directions between the parts of the embodiments. It will be appreciated that certain embodiments, or portions thereof, can also be oriented in other positions. In addition, the term "about" should generally be understood to refer to both the corresponding number and a range of numbers. In addition, all numerical ranges herein should be understood to include each whole integer within the range.

While illustrative embodiments of the invention are disclosed herein, it will be appreciated that numerous modifications and other embodiments may be devised by those skilled in the art. For example, the features for the various embodiments can be used in other embodiments. The converter having a drum, for example, can be replaced with other types of converters. Therefore, it will be understood that the appended claims are intended to cover all such modifications and embodiments that come within the spirit and scope of the present invention.

What is claimed is:

1. A dunnage system comprising:

a dunnage converting station that pulls stock sheet material in a longitudinal direction from a supply station and converts the stock material into low-density dunnage, the dunnage converting station including:

an intake member having an outer structure that defines an opening that constricts the stock material as the stock material is pulled into and through the intake member; and a stock material shaping member positioned upstream of the intake member and on an upstream portion of the converting station to bend the stock material pulled from the supply station about a transverse axis that extends generally transversely to the longitudinal direction, the stock material shaping member including:

a support structure that extends in generally the same direction as the transverse axis and causes the stock material to bend about the transverse axis, and a central protrusion extending radially from a surface of the support structure and that protrudes more deeply into the bend in the stock material than the support structure, causing the stock material to bend about both the transverse axis and a longitudinal axis that extends generally in the longitudinal direction generally centrally into the stock material as the stock material moves longitudinally across the support structure and the central protrusion.

2. The dunnage system of claim 1, wherein the dunnage converting station includes a drive mechanism operable to pull the stock material into the intake member.

3. The dunnage system of claim 2, wherein the intake includes a structural member that defines an opening disposed between the shaping member and the drive mechanism, which opening constricts the stock material as the stock material is pulled into and through the dunnage intake member in a longitudinal direction.

4. The dunnage system of claim 3, wherein the shaping member is between 2 and 8 times wider than the opening.

5. The dunnage system of claim 1, wherein the shaping member manipulates the path of the stock material in a way that causes the stock material to begin to bend or curl prior to being pulled into the intake member.

6. The dunnage system of claim 1, further comprising a supply station configured to hold stock material that has a stock material width.

7. The dunnage system of claim 6, wherein the support structure extends across less than a full width of the stock material.

8. The dunnage system of claim 7, wherein the support structure includes transverse free ends that allow the stock material to wrap around the free ends.

9. The dunnage system of claim 7, further comprising the stock material.

10. The dunnage system of claim 6, wherein the support structure extends across more than a full width of the stock material.

11. The dunnage system of claim 6, wherein the supply station is configured to hold stock material that is wider than the width of the shaping member.

12. The dunnage system of claim 1, wherein the support structure is a transversely extending cylindrical bar.

13. The dunnage system of claim 1, wherein the central protrusion is a semi-circular protrusion, with the semi-circular protrusion having an axis that is perpendicular to a transversely extending axis of the support structure.

14. The dunnage system of claim 1, wherein the central protrusion extends away from the surface of the support structure a distance between approximately 1/10 and 1/2 of the length of the support structure.

15. The dunnage system of claim 1, wherein the central protrusion extends between about 15° and 75° off a horizontal plane passing through a center axis of the support structure in an upstream direction with respect to the intake member.

16. The dunnage system of claim 1, wherein the shaping member is connected to the intake member by a connection member extending therefrom.

17. The dunnage system of claim 1, wherein the shaping member is positioned to change the direction of the stock material as the stock material is pulled from a supply station and through the intake.

18. The dunnage system of claim 1, wherein the dunnage converting station includes:

a transverse barrier member extending from the outer structure in a direction that corresponds to the direction of the transverse width of stock material that is pulled into and through the intake member such that the transverse barrier member limits the tendency of the stock material to wrap around the outer structure without significantly restraining the stock material in an upstream direction; and a drive mechanism positioned downstream of the converting station, the drive mechanism receiving and pulling the stock material through the intake member.

19. The dunnage system of claim 18, wherein the transverse barrier member includes ears protruding transversely from the intake member and having a height less than the intake member.

20. The dunnage system of claim 19, wherein at least one ear forms an attachment to a stand.

21. The dunnage system of claim 18, wherein the shaping member is positioned upstream of the intake, the shaping member configured to manipulate the stock material along its path in a way that causes the stock material to begin to bend or curl prior to being pulled into the intake.

22. The dunnage system of claim 1, wherein the dunnage converting station includes a transverse barrier member extending from the outer structure in a direction that corresponds to the direction of the transverse width of stock material that is pulled into and through the intake member.

23. A dunnage converting station that pulls stock sheet material in a longitudinal direction from a supply station and converts the stock material into low-density dunnage comprising:

an intake member; and a stock material shaping member positioned upstream of the intake member and on an upstream portion of the converting station to bend the stock material pulled from the supply station about a transverse axis that extends generally transversely to the longitudinal direction, the stock material shaping member including:

a support structure that extends in generally the same direction as the transverse axis and causes the stock material to bend about the transverse axis, and a central protrusion extending radially from a surface of the support structure and that protrudes more deeply into the bend in the stock material than the support structure, causing the stock material to bend about both the transverse axis and a longitudinal axis that extends generally in the longitudinal direction generally centrally into the stock material as the stock material moves longitudinally across the support structure and the central protrusion.

* * * * *